US006160514A

United States Patent [19]

Judd

[11] Patent Number: 6,160,514

[45] Date of Patent: Dec. 12, 2000

[54] L-SHAPED INDOOR ANTENNA

[75] Inventor: Mano D. Judd, Rockwall, Tex.

[73] Assignee: Andrew Corporation, Orland Park, Ill.

[21] Appl. No.: 09/418,737

[22] Filed: Oct. 15, 1999

[51] Int. Cl.[7] ..... H01Q 1/38

[52] U.S. Cl. ..... 343/700 MS; 343/853

[58] Field of Search ..... 343/700 MS, 795, 343/828, 853

[56] References Cited

U.S. PATENT DOCUMENTS 4,983,988 1/1991 Franke ..... 343/853

5,552,798 9/1996 Dietrich et al. ..... 343/893

*Primary Examiner*—Tan Ho

*Attorney, Agent, or Firm*—Stephen G. Rudisill; Jenkens & Gilchrist, P.C.

[57] ABSTRACT

An antenna system includes a first support member having a first pair of opposed planar support surfaces and a second support member having a second pair of opposed planar support surfaces. The first and second support members are coupled along a common edge and oriented such that the first pair of planar support surfaces are substantially orthogonal to the second pair of planar support surfaces. At least one antenna element is mounted to each of the support surfaces of the first and second pairs of support surfaces.

56 Claims, 8 Drawing Sheets

L-SHAPED INDOOR ANTENNA

BACKGROUND OF THE INVENTION

In conventional cellular and PCS (personal communications system) wireless systems, signals transmitted from a base station (cell site) to a user (remoter terminal) are usually received via an omni-directional antenna; often in the form of a stub antenna. These systems often sacrifice bandwidth to obtain better area coverage, stemming from the result of less than desirable signal propagation characteristics. For instance, the bit (binary digit) to Hz ratio of the typical digital Cellular or PCS system is often less than 0.5. Lower binary signal modulation types, such as BPSK (Binary Phase Shift Keying) are used, since the effective SNR (Signal to Noise Ratio) or C/I (Carrier to Interference Ratio) are often as low as 20 dB. In fact, for voice based signaling, the threshold C/I (or S/N) ratio for adequate quality reception of the signal is about 17 dB.

For wireless systems directed towards data applications, it is desirable to significantly increase the SNR or C/I in order to employ higher order (binary) modulation techniques, such as QAM-64 (Quadrature Amplitude Modulation, with 64 points in the complex constellation). These higher order modulation schemes require substantially greater C/I (or SNR) thresholds; typically higher than 26 dB. For the case of MMDS (multi-user multipath distribution system) signals, where the carrier frequencies are higher (around 2500 MHz), the propagation characteristics are even worse. There is a need therefore for transmission systems that can both satisfy the coverage (propagation) demands, as well as generate high C/I or SNR levels.

One option is to increase the size of the terminal equipment (TE), or remote, antenna gain. This requires increasing the size. Additionally, it helps to increase the elevation (i.e., vertical height above ground level) of the antenna. The higher you place an antenna, the better the system gain. For a simple planar earth model, the total system path loss (attenuation) is a function of each (transmit and receive) antenna's directive gain (towards one another). However, this path loss is also a function of the height (from ground level) of each antenna. Thus, as you increase the height, from ground, the total system path loss decreases, which is an increase in the overall system link performance, or system gain. The link performance (system) gain increases 6 dB every time you double one of the antenna's height from the ground level. If you double both (i.e., transmitting and receiving) antennas' heights, the total gain (link performance) goes up by 12 dB (6 dB+6 dB). Therefore, doubling the height from the ground is equivalent to quadrupling the size (area) of the antenna; which produces 4× (or 6 dB) of directive gain.

In conventional analog MMDS systems, this (i.e., increase of SNR or C/I) has been traditionally accomplished by installing a large reflector type antenna (with up to 30 dBi of directional gain) on a rooftop, or a pole. The disadvantages are a complex, difficult, and costly installation; as well as poor aesthetics.

The migration of the MMDS frequency spectrum, from an analog video system, to a wireless data and Internet system, demands a more user friendly (easier) installation method, with much lower cost. The difficulty here is designing a system with sufficient directional gain, as to overcome loss with transmission through walls, as well as being easy to install, and orient; by the consumer, or other persons without specialized skills.

SUMMARY OF THE INVENTION

In accordance with one aspect of the invention, there is provided an easy to install, high gain, omni-directional "indoor" antenna which provides omni-directional coverage. No installation, "pointing" or orientation is required, and the antenna may be installed indoors in a corner of a room.

In accordance with another aspect of the invention, four antenna elements are formed as a "book," that is, two each, back to back; with the pairs oriented at 90° to each other, such that each separate antenna covers a 90° sector, so that the coverage of the antennas when summed creates a full 360° coverage.

DETAILED DESCRIPTION OF THE ILLUSTRATED EMBODIMENT

Figure 1:
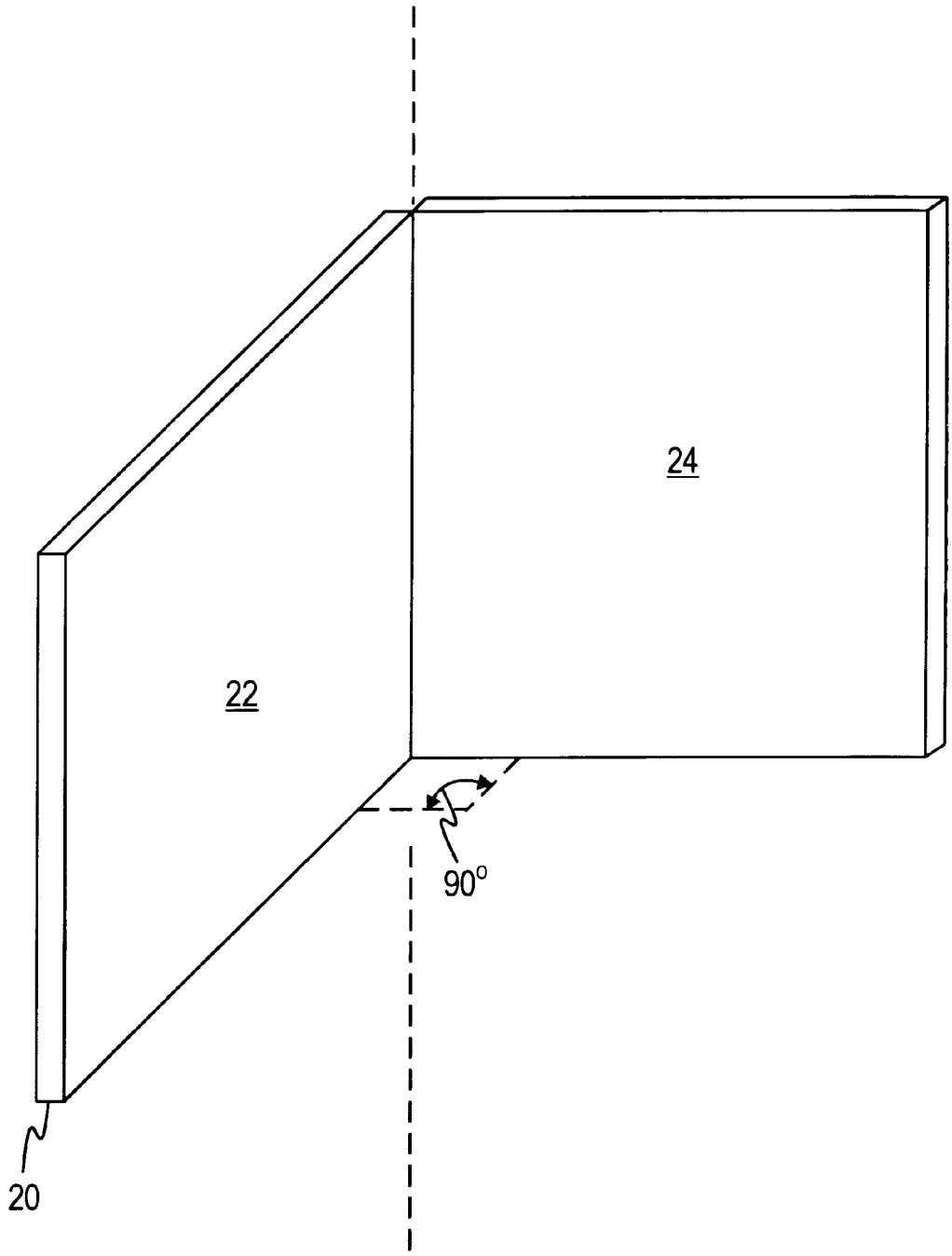
FIG. 1 is a perspective view showing an antenna in accordance with the one form of the invention.
Figure 2:
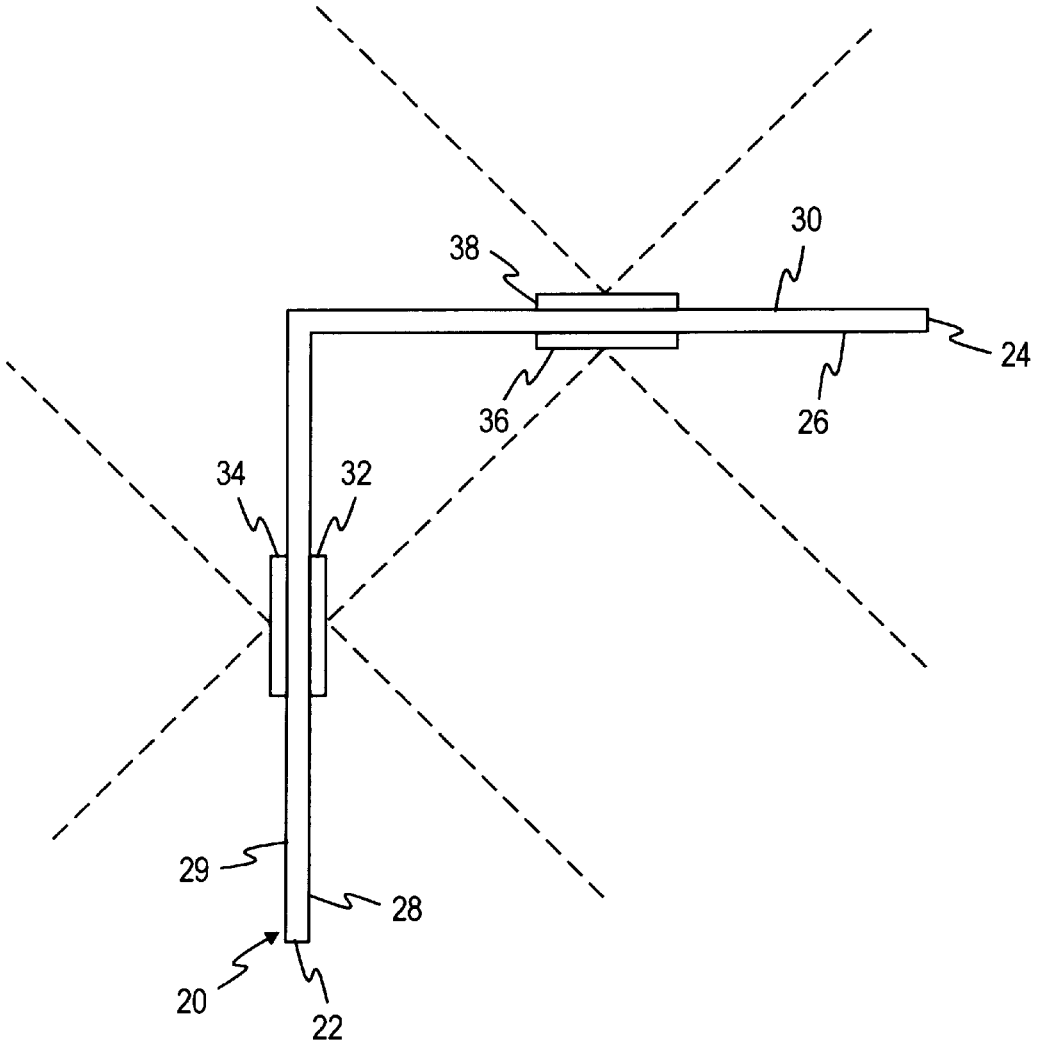
FIG. 2 is a top plan view of the antenna of FIG. 1.

Referring initially to FIG. 1 and FIG. 2, there is shown the general structure for a "book" antenna system 20 in accordance with the invention, having two rectangular (shown square in FIG. 1) sections 22, 24 joined along a common edge. The two sections, 22, 24 are joined at a 90 degree angle, thus allowing the antenna 20 to fit squarely into a corner, between two walls, in a room (see FIG. 3), so as to resemble an open "book" in appearance.

Using microstrip (patch) antenna technology allows the thickness of the sections 22, 24 to be well under one inch. Each section 22, 24 is comprised of a front (26, 28) and a back (29, 30), with each face (front and back) containing an antenna element 32, 34, 36, 38 (or multiplicity of elements, in an array, see, e.g., FIGS. 4, 5 and 7). Thus there are four (4) distinct antenna faces, each pointing in opposing or orthogonal directions from one another.

FIG. 2 shows a top view of the antenna system, denoting the four distinct faces 26, 28, 29 and 30. Each face contains a microstrip/patch antenna 32, 34, 36 and 38. For this particular example, each patch antenna 32, 34, 36, 38 generates a 90 ° azimuth beam width. The combination of the four 90 degree beams generates an effective 360 degree coverage; thereby emulating an omni-directional antenna.

Figure 3:
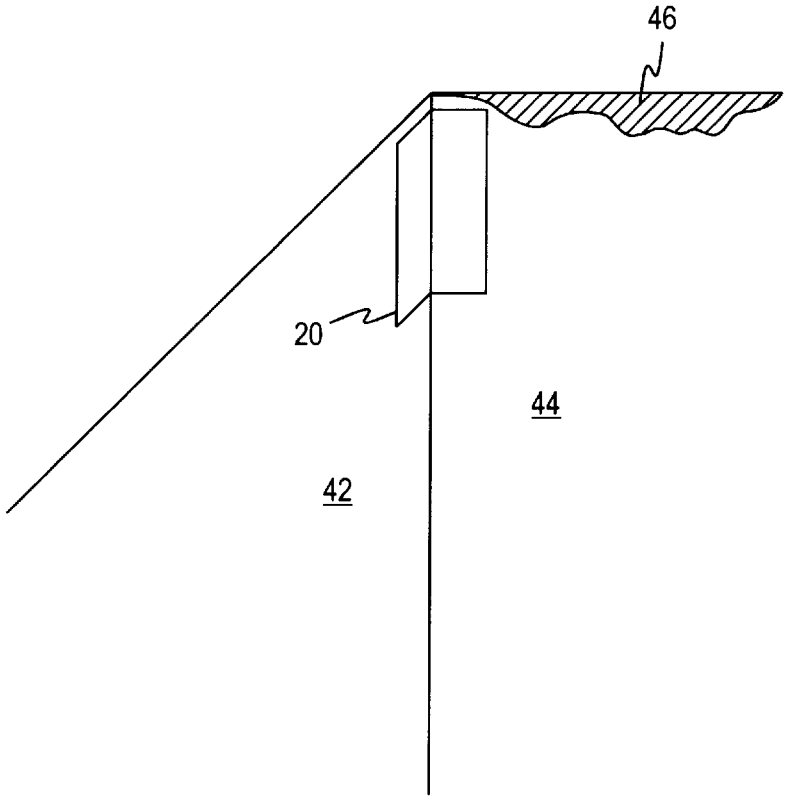
FIG. 3 is a perspective view, showing an antenna in accordance with the invention placed in a typical room.

FIG. 3 shows the placement of the antenna 20 at the corner of two walls 42, 44. For optimal performance the antenna system should be placed as high as possible (i.e. near the ceiling 46) to maximize signal reception and transmission to a base station (not shown).

Figure 4:
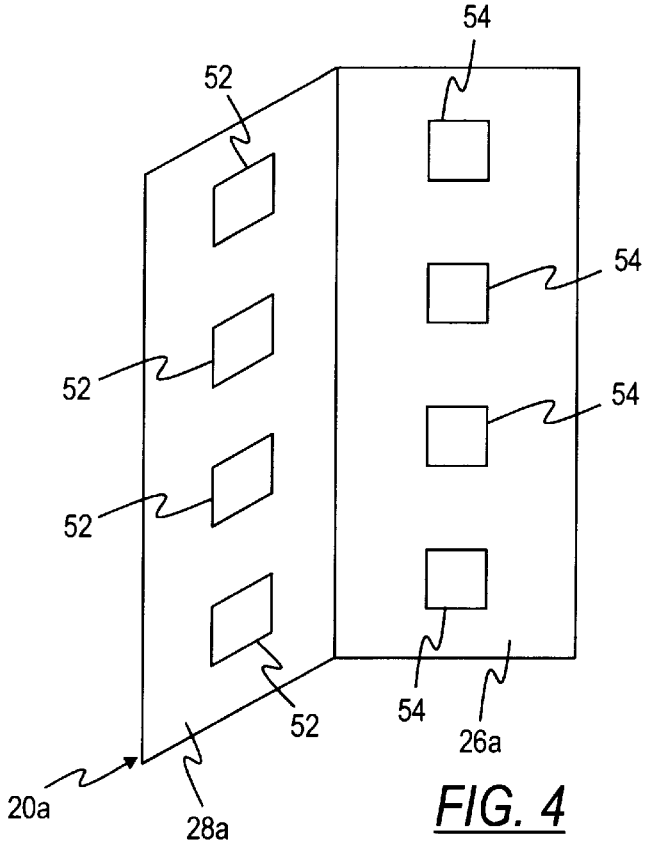
FIGS. 4 and 5 are views similar to FIG. 1, showing antennas in accordance with two further embodiments of the invention.
Figure 5:
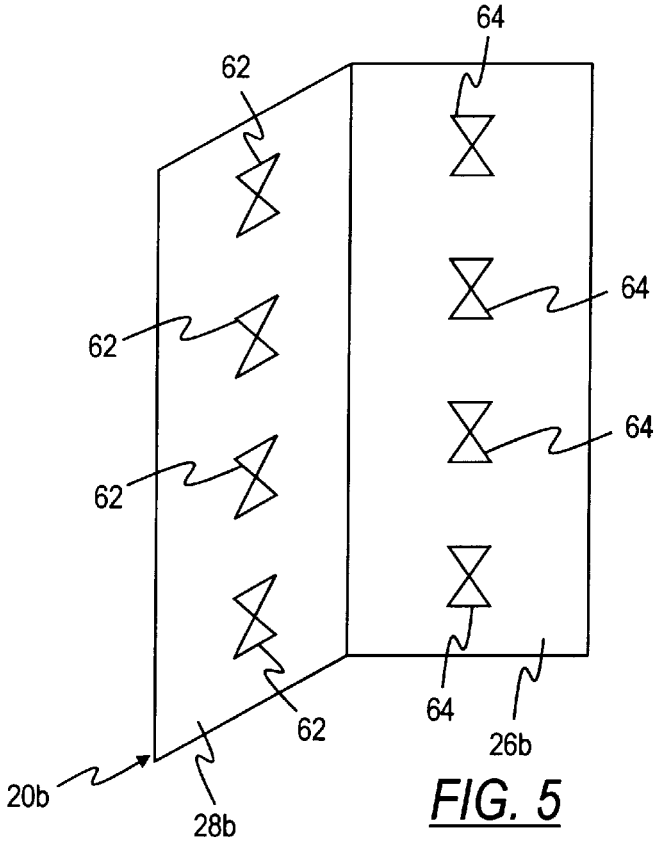

FIGS. 4 and 5 show two different variants of antenna element types, which can be used as or in place of the antenna elements 32, 34, 36, 38 of the preceding embodiments. FIG. 4 shows a vertical array (multiplicity of elements) of patch/microstrip antenna elements 52, 54, on each face 26*a*, 28*a* of a "book" antenna 20*a*. It will be understood that similar arrays are on the rear faces which are not visible in FIG. 4. For the case of a multiplicity of antenna elements (on each face) a parallel or series corporate feed structure (not shown) would be used, designed for correct amplitude and phase matching, to generate the desired elevation beam. FIG. 5 shows the same sort of arrays, however, using dipole antenna elements 62, 64, on faces 26*b*, 28*b* of "book" antenna 20*b*. Similar arrays of dipoles are used on the other two faces which are not visible in FIG. 5.

Figure 6:
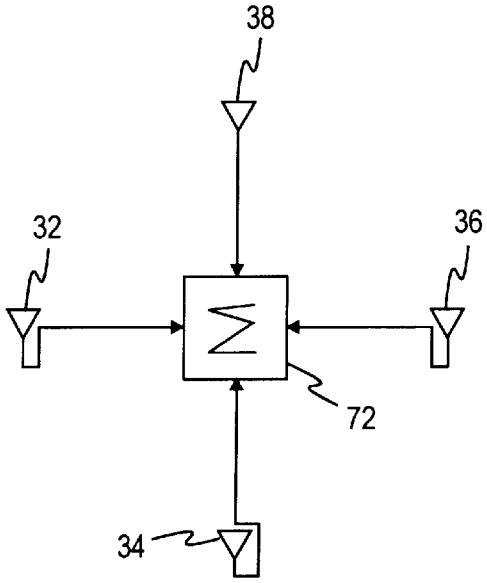
FIG. 6 is a schematic showing of a summation/splitting device.

FIG. 6 shows a summation/splitting mechanism 72, in which the input/output path(s) from the antenna element(s) on each face of the "book" antenna of any of the preceding figures is RF summed to generate a single RF input/output path to/from the antenna system. For each of the four faces, the array corporate feed (or RF transmission line, for the case of a single element) is summed, in phase, with the other faces, to generate a single RF input/output.

Figure 7:
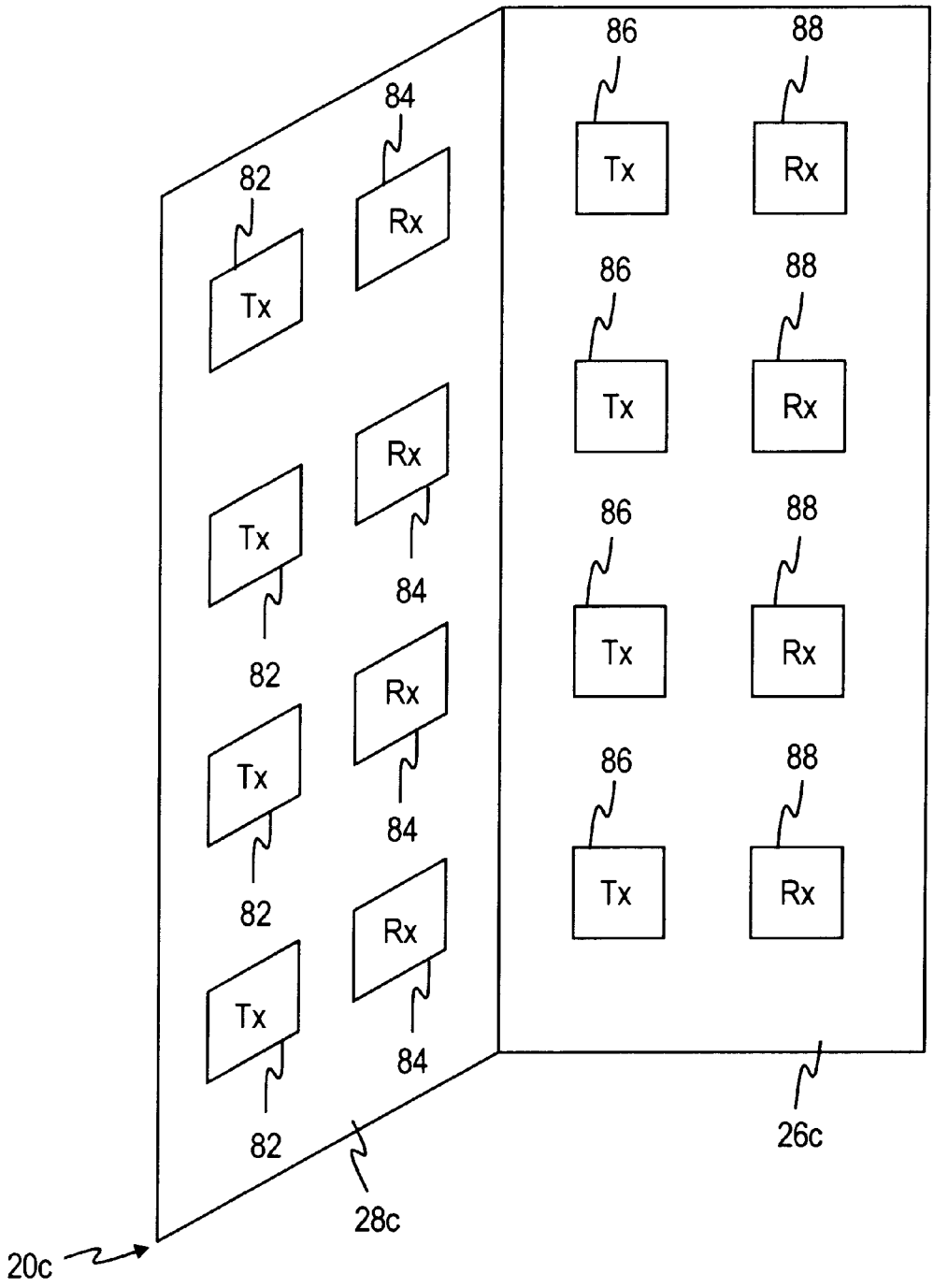
FIG. 7 is a view similar to FIG. 1 showing an antenna in accordance with yet another embodiment of the invention.

Up to this point, it has been assumed that the transmit and receive bands of the system are all within the VSWR bandwidth of a single patch/microstrip (or dipole) element. However, for the case where the transmit and receive bands of the system are further apart (say, more than 10% of the carrier frequency), then two different arrays can be used for each face. Shown in FIG. 7, is the case where there is a transmit (Tx) patch/microstrip (or dipole) array (vertical) 82, 86 and a receive (Rx) array (vertical) 84, 88, on each face 26*c*, 28*c* of antenna 20*c*. The same arrangement of Tx and Rx elements would be used on the faces which are not visible in FIG. 7. Two distinct sum/split circuits of the type shown in FIG. 6 would be used (see e.g., FIG. 8)—one for Tx and one for Rx, generating two distinct, separate RF ports (one for the transmit band, and one for the receive band). The antenna system can therefore output two different RF transmission lines, or cable, or (frequency) diplex them (via a frequency diplexer module 95, see FIG. 8) into a single RF transmission line, or cable 90.

Figure 8:
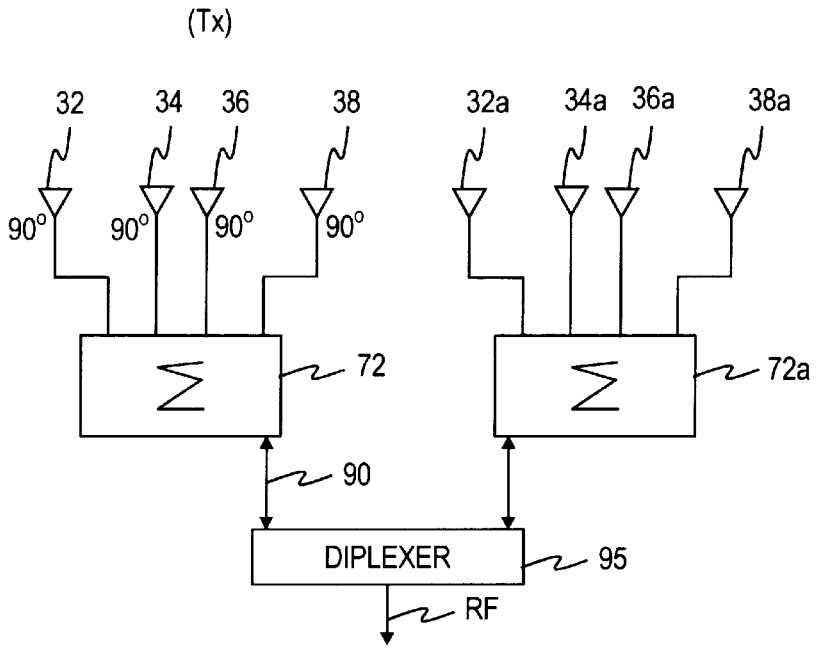
FIG. 8 is a schematic view, similar to FIG. 6, further illustrating a summer/splitter.
Figure 9:
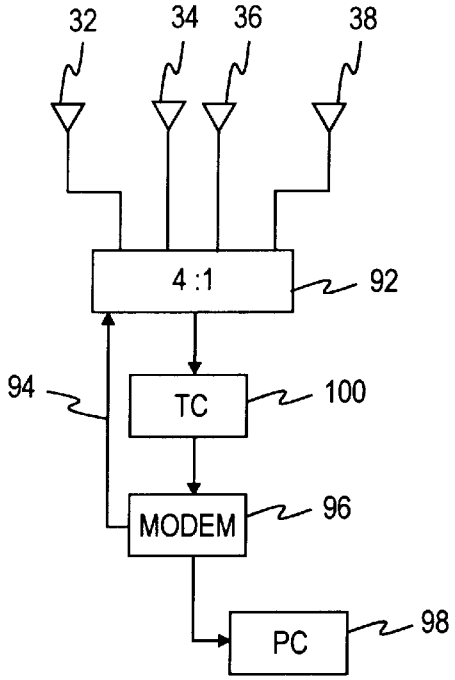
FIG. 9 is a schematic view illustrating use of a 4:1 RF switch with control from a modem.

The concept as described thus far generates an omni-directional system, which splits the power (four ways) from the input/output transmission line, to each independent 90 degree sector "face," as indicated in FIG. 8. However, this splitting/summing device 72 (72*a*) has the effect of reducing the overall system directional gain by 6 dB. One method to overcome this is to substitute a 4:1 RF switch 92 as shown in FIG. 9. This can be a combination of PIN diodes (not shown), which are biased/controlled via a control line 94 (or set of control lines) from a modem 96. The modem 96, or an associated contoller or "PC" 98 can be programmed to sequentially switch the RF path to each antenna face, measure the RF power, and then select the face with the maximum power. A suitable RF transceiver/transverter (Tc) 100 is interposed between the 4:1 RF switch 92 and the modem 96. In this case, the system would still have omni-directional capability, yet would increase the overall system (directive) gain by 6 dB. This additionally reduces the amount of signal scattered throughout the network, and increases the overall network C/I. This also increases the user friendliness of the system, allowing easier installation by the user, with the antenna "pointing" done by the system itself.

Figure 10:
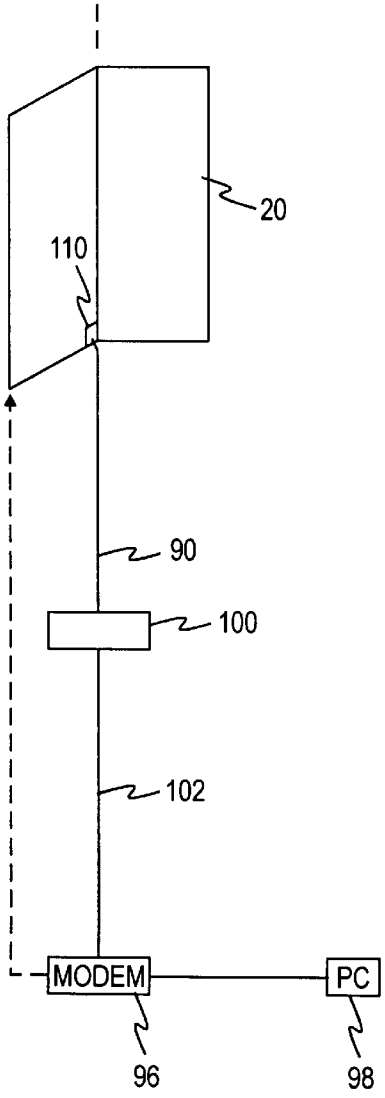
FIG. 10 is a diagrammatic showing of an antenna in accordance with one form of the invention, having an internal RE summer/splitter.

FIG. 10 shows one embodiment of the "book" antenna 20 of the invention at a corner of two walls 42, 44, with an internal (i.e., built into the antenna structure) RF Summer/Splitter or a 4:1 RF switch 110, with control from the modem 96 shown by the dotted line in the case of a 4:1 RF switch. The RF output (coaxial line) 90 from the antenna system can run down the corner of the wall into the RF transceiver 100 (or "transverter", as it is denoted in the MMDS industry). The RF transceiver 100 is interfaced to the modem 96 via an IF cable 102 (coaxial or twisted pair). The RF switch 110 may be physically mounted to the surface of the substrate or backplane (such as a printed circuit board or card) which forms one of the sections 22, 24.

Figure 11:
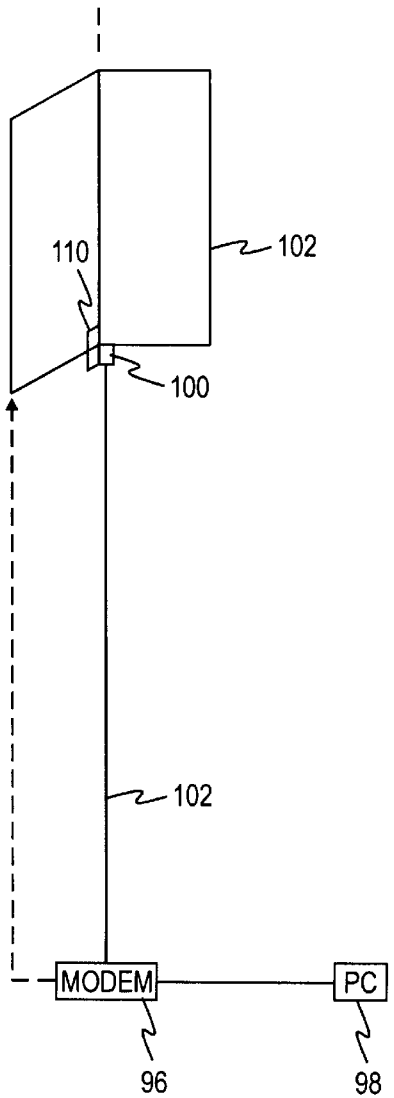
FIG. 11 is a view similar to FIG. 10 showing an RF transceiver or transverter incorporated into the antenna assembly.

FIG. 11 shows an embodiment where the RF transceiver ("transverter") 100 is also incorporated into the antenna assembly. This can be accomplished via a separate (transceiver) box attached to the unit, or by incorporating the transceiver electronics onto the same PCB material as the microstrip antennas.

Figure 12:
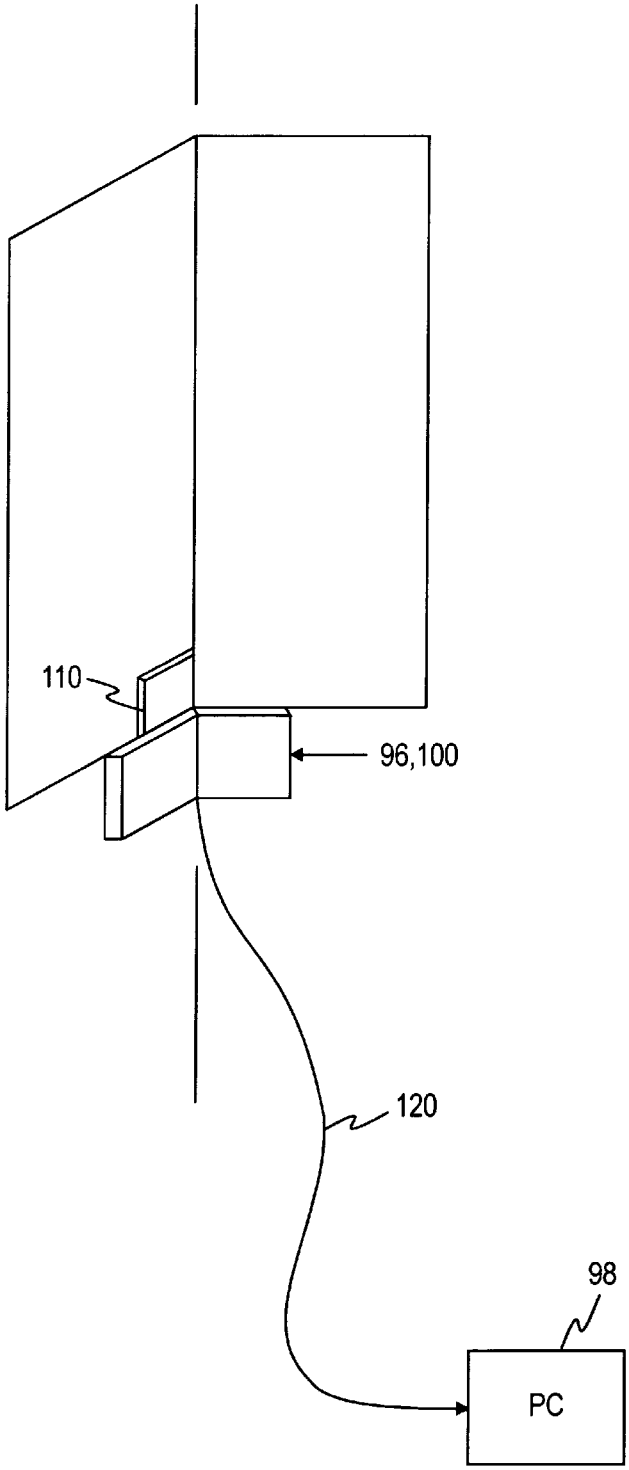
FIG. 12 is a view similar to FIGS. 10 and 11 showing both a transceiver and modem incorporated into the antenna assembly.

FIG. 12 shows incorporation of both the transceiver 100 and modem 96 into the antenna assembly. Here, an Ethernet or USB (Universal Serial Bus) cable 120 is run down the wall corner directly to the PC 98, or LAN network server.

The antenna of the invention may be used in many applications including without limitation:

MMDS (Wireless Internet)

MMDS (analog video)

Cellular (indoor)

PCS (indoor)

3G systems

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An antenna system comprising a first support member having a first pair of opposed planar support surfaces, a second support member having a second pair of opposed planar support surfaces, said first and second support members being coupled along a common edge and oriented such that first pair of planar support surfaces are substantially orthogonal to said second pair of planar support surfaces; and at least one antenna element mounted to each of said support surfaces of said first and said second pair of support surfaces.

2. The antenna system of claim 1 wherein said first and second support members comprise printed circuit boards.

3. The antenna system of claim 1 wherein each of said antenna elements comprises a single microstrip/patch element.

4. The antenna system of claim 1 wherein each of said antenna elements comprises a single dipole element.

5. The antenna system of claim 1 wherein each of said antenna elements comprises an antenna array.

6. The antenna system of claim 5 wherein each said antenna array comprises an array of microstrip/patch antenna elements.

7. The antenna system of claim 5 wherein each said antenna array comprises an array of dipole antenna elements.

8. The antenna system of claim 5 wherein each said array comprises a plurality of antenna elements arranged in a vertical column.

9. The antenna system of claim 5 and further including a corporate feed structure which operatively interconnects the antenna array.

10. The antenna system of claim 9 and further including a summation/splitting circuit operatively coupled with said corporate feed structure of each antenna array and which sums, in phase, radio frequency signals to and from each array to generate a single RF input/output path.

11. The antenna system of claim 10 wherein said corporate feed structure provides amplitude and phase matching to generate a desired elevation beam.

12. The antenna system of claim 9 wherein said corporate feed structure provides amplitude and phase matching to generate a desired elevation beam.

13. The antenna system of claim 1 wherein at least two antenna elements are mounted to each of said support surfaces, one to transmit and one to receive.

14. The antenna system of claim 13 wherein each of said transmit and receive antenna elements comprises an array of antenna elements.

15. The antenna system of claim 14 wherein the antenna elements of each of said arrays is arranged in a generally vertical column.

16. The antenna system of claim 14 wherein said arrays comprise transmit arrays and receive arrays, and further including a corporate feed structure which couples each transmit antenna array to one signal input and each receive antenna array to one signal output.

17. The antenna system of claim 16 and further including a first summation/splitting circuit coupled with the corporate feed structure coupled to said receive antenna arrays and a second summation/splitting circuit coupled with the corporate feed structure coupled to the transmit antenna arrays, to define respective transmit and receive RF ports.

18. The antenna system of claim 17 and further including a frequency diplexer for diplexing said transmit and receive RF ports into a single transmission line.

19. The antenna system of claim 14 wherein each said array comprises an array of microstrip/patch antenna elements.

20. The antenna system of claim 13 and further including a first summation/splitting circuit coupled with the receive antennas and a second summation/splitting circuit coupled with the transmit antennas for generating respective transmit and receive RF input/output ports.

21. The antenna system of claim 20 and further including a frequency diplexer for diplexing said two RF ports into a single transmission line.

22. The antenna system of claim 1 and further including a summation/splitting circuit operatively coupled with said antenna elements, which sums/splits radio frequency signals from/to said antenna elements to generate a single radio frequency input/output path from the antenna system.

23. The antenna system of claim 22 wherein said summation/splitting circuit is mounted to said support member.

24. The antenna system of claim 23 wherein said support member comprises a printed circuit board and wherein said summation/splitting circuit is mounted on said printed circuit board.

25. The antenna system of claim 23 and further including a transceiver/transverter coupled to receive signals from said antenna elements.

26. The antenna system of claim 25 wherein said support member comprises a printed circuit board and wherein said summation/splitting circuit and said transceiver/transverter are mounted to said printed circuit board.

27. The antenna system of claim 1 and further including a RF switch and a modem programmed to sequentially switch the RF path, via said RF switch, to the antenna element mounted to each support surface, to select the antenna element with the maximum received RF signal level.

28. The antenna system of claim 27 wherein said RF switch is mounted to said support member.

29. The antenna system of claim 28 wherein said support member comprises a printed circuit board and wherein said RF switch is mounted on said printed circuit board.

30. The antenna system of claim 28 wherein a modem is mounted to said support member and operatively coupled to said RF switch.

31. The antenna system of claim 30 wherein said support member comprises a printed circuit board and wherein said RF switch and said modem are mounted on said printed circuit board.

32. The antenna system of claim 30 and further including a transceiver/transverter coupled to said RF switch.

33. The antenna system of claim 32 wherein said support member comprises a printed circuit board and wherein said RF switch, said modem, and transceiver/transverter are mounted to said printed circuit board.

34. The antenna system of claim 28 and further including a transceiver/transverter coupled to said RF switch.

35. The antenna system of claim 34 wherein said support member comprises a printed circuit board and wherein said RF switch and said transceiver/transverter are mounted to said printed circuit board.

36. The antenna system of claim 1 and further including a transceiver/transverter coupled to receive signals from said antenna elements.

37. The antenna system of claim 30 wherein said support member comprises a printed circuit board and wherein said transceiver/transverter is mounted to said printed circuit board.

38. A method of constructing an antenna system comprising:

coupling a first support member having a first pair of opposed planar support surfaces along a common edge with a second support member having a second pair of opposed planar support surfaces;

orienting said first and second support members such that first pair of planar support surfaces are substantially orthogonal to said second pair of planar support surfaces; and mounting at least one antenna element to each of said support surfaces of said first and said second pair of support surfaces.

39. The method of claim 38 including mounting a plurality of said antenna elements to each of said support surfaces and arranging the antenna elements on each support surface as an antenna array.

40. The method of claim 39 and further including aligning the plurality of antenna elements of each array in a vertical column.

41. The method of claim 39 including designating a first group of one or more of said antenna elements on each support surface as transmit antenna elements and a second group of one or more of antenna elements on each support surface as receive antenna elements.

42. The method of claim 41 including arranging each of said first and second groups of antenna elements in a generally vertical column.

43. The method of claim 41 including summing the group of receive antenna elements to one signal output and splitting the group of transmit antenna elements from one signal input.

44. The method of claim 43 and further including diplexing said signal output and signal input into a single transmission line.

45. The method of claim 39 and further including a summing in phase, radio frequency signals to and from each array to generate a single RF input/output path.

46. The method of claim 45 including arranging a corporate feed structure to provide amplitude and phase matching so as to generate a desired elevation beam.

47. The method of claim 39 including arranging a corporate feed structure to provide amplitude and phase matching for said antenna elements so as to generate a desired elevation beam.

48. The method of claim 38 including mounting at least two antenna elements to each of said support surfaces, and designating at least one of said antenna elements to transmit and at least one of said antenna elements to receive.

49. The method of claim 38 and further including summing/splitting radio frequency signals from said antenna elements to generate a single radio frequency input/output.

50. The method of claim 49 including mounting a summation/splitting circuit for performing said summing and splitting to at least one of said support members.

51. The method of claim 50, including coupling a transceiver/transverter to said summation/splitting circuit and mounting said transceiver/transverter to at least one of said support members.

52. The method of claim 38 and further including sequentially switching the RF path to the at least one antenna element mounted to each support surface, to select the at least one antenna element with the maximum received RF signal level.

53. The method of claim 52 including mounting an RF switch to at least one of said support members to perform said sequential switching.

54. The method of claim 53 including operatively coupling a modem to said RF switch and mounting said modem to at least one of said support members.

55. The method of claim 54 and further including coupling a transceiver/transverter to said RF switch and mounting said transceiver/transverter to at least one of said support members.

56. The method of claim 53 and further including coupling a transceiver/transverter to said RF switch and mounting said transceiver/transverter to at least one of said support members.

* * * * *

UNITED STATES PATENT AND TRADEMARK OFFICE

CERTIFICATE OF CORRECTION

PATENT NO.: 6,160,514

DATED: December 12, 2000

INVENTOR(S): Mano D. Judd

It is certified that errors appear in the above-identified patent, and that said Letters Patent is hereby corrected as shown below.

Column 6, Claim 37, line 38, delete "30" and insert --36--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*